US009498036B1

(12) United States Patent
Osorio et al.

(10) Patent No.: US 9,498,036 B1
(45) Date of Patent: Nov. 22, 2016

(54) DIVIDER AND KIT

(71) Applicant: Bento Tek, Inc., Merrick, NY (US)

(72) Inventors: Olga Lisa Osorio, West Hempstead, NY (US); Alexander de la Teja, Baldwin, NY (US); Lucy Pellegrino, Massapequa, NY (US)

(73) Assignee: BENTOTEK, INC, Merrick, NY (US)

( * ) Notice: Subject to any disclaimer, the term of this patent is extended or adjusted under 35 U.S.C. 154(b) by 251 days.

(21) Appl. No.: 14/491,692

(22) Filed: Sep. 19, 2014

Related U.S. Application Data

(60) Provisional application No. 61/884,377, filed on Sep. 30, 2013.

(51) Int. Cl.
*A45C 11/20* (2006.01)
*F25D 3/00* (2006.01)
*F25D 11/00* (2006.01)

(52) U.S. Cl.
CPC ..... *A45C 11/20* (2013.01); *F25D 3/00* (2013.01); *F25D 11/003* (2013.01)

(58) Field of Classification Search
CPC ..... A45C 11/20; F25D 11/003; F25D 3/00
See application file for complete search history.

(56) References Cited

U.S. PATENT DOCUMENTS 1,559,307 A 10/1925 Bernardo
1,895,744 A 1/1933 Arnold
2,463,993 A 3/1949 Meyers
3,777,418 A 12/1973 Cooper
3,869,595 A 3/1975 Collins et al.
4,311,022 A * 1/1982 Hall ..... A45C 11/20 62/372
4,354,542 A 10/1982 Gerch
4,453,623 A 6/1984 Horii
4,499,997 A 2/1985 Swingley
4,506,769 A * 3/1985 Franco ..... A45C 3/00 16/DIG. 40
4,630,671 A 12/1986 Sherman (Continued)

FOREIGN PATENT DOCUMENTS

AU 2011100133 A 4/2011
CN 201375131 1/2010

(Continued)

OTHER PUBLICATIONS

Unknown, Quilted non-woven lunch bag with inside bottle holders, 2014, Alibaba Group, URL: http://www.alibaba.com/product-detail/quilted-non-woven-lunch-bag-with_568453252.html.

(Continued)

*Primary Examiner* — Emmanuel Duke
(74) *Attorney, Agent, or Firm* — Werschulz Patent Law, LLC

(57) ABSTRACT

A carrying kit comprising a bag, a hot-cold pack and a divider configured for maintaining food at desired temperature during transport. The configurable flexible divider has at least one panel operative for creating insulated cells within a cavity of the bag, the cells isolating a plurality of items in the bag, one from the other. The cells can be maintained at different temperatures by hot-cold disposed within the panels of the divider. The divider further protects the items within the cell from crushing and from shock. In one example embodiment, the bag has an adjustable shelf splitting the cavity into upper and lower portions. The shelf attaches to the cavity by at least one flap that rises and lowers the shelf. The lower cavity portion is accessible through a horizontal opening.

16 Claims, 12 Drawing Sheets

(56) References Cited

U.S. PATENT DOCUMENTS

| | | | | |
|---|---|---|---|---|
| 4,930,637 | A | 6/1990 | DeRoseau | |
| 5,209,279 | A | 5/1993 | Wilson | |
| D351,536 | S | 10/1994 | Maydwell | |
| 5,421,172 | A | 6/1995 | Jones | |
| 5,501,338 | A | 3/1996 | Preston | |
| D371,056 | S | 6/1996 | Sullivan | |
| 5,570,588 | A * | 11/1996 | Lowe | B65D 81/3818 62/457.7 |
| 5,842,571 | A | 12/1998 | Rausch | |
| 5,950,834 | A | 9/1999 | Levin | |
| 6,112,899 | A | 9/2000 | Zerinque | |
| 6,173,839 | B1 * | 1/2001 | Dieter | A45C 3/001 190/110 |
| D457,307 | S | 5/2002 | Pukall et al. | |
| D463,960 | S | 10/2002 | McDonald | |
| 6,644,063 | B2 | 11/2003 | Mogil | |
| 6,938,793 | B2 | 9/2005 | Lerner | |
| 7,004,323 | B1 | 2/2006 | Symonds | |
| 7,302,810 | B2 | 12/2007 | McCrory | |
| 7,334,684 | B1 | 2/2008 | Fontanilla | |
| 7,353,952 | B2 | 4/2008 | Swartz et al. | |
| D587,895 | S | 3/2009 | Patadia et al. | |
| 7,607,540 | B2 | 10/2009 | Ballard | |
| D604,503 | S | 11/2009 | Patadia et al. | |
| 7,900,757 | B2 | 3/2011 | Sisitsky | |
| 7,968,132 | B2 | 6/2011 | Archie | |
| 2002/0084206 | A1 | 7/2002 | Protopapas | |
| 2004/0262319 | A1 | 12/2004 | Fisher | |
| 2005/0103044 | A1 * | 5/2005 | Mogil | A45C 11/20 62/457.7 |
| 2006/0027293 | A1 | 2/2006 | Willems | |
| 2010/0263399 | A1 | 10/2010 | Pollina | |
| 2011/0146856 | A1 | 6/2011 | Vancelette | |
| 2012/0012235 | A1 | 1/2012 | Freiman | |
| 2013/0048164 | A1 | 2/2013 | Fleming | |
| 2014/0079344 | A1 * | 3/2014 | Quehl | A45C 7/0086 383/210 |
| 2014/0124316 | A1 | 5/2014 | Runner et al. | |

FOREIGN PATENT DOCUMENTS

| | | | |
|---|---|---|---|
| JP | 2013056139 | A | 3/2013 |
| WO | WO9204586 | | 3/1992 |
| WO | 0070994 | A1 | 11/2000 |
| WO | WO03052332 | | 6/2003 |

OTHER PUBLICATIONS

Unknown, Tupperware Trendy Lunch Box with Insulated Bag, Cheapest India website, 2014, India,URL: http://cheapestinindia.com/price/tupperware-trendy-lunch-box-with-insulated-bag-3426217.

Unknown, The Perfect Bag for the Perfect Vacation—Down Under, TravelandLeisure.com, Mar. 11, 2010, blog, Time, Inc., USAURL:http://www.travelandleisure.com/travel-blog/carry-on/2010/3/11/the-perfect-bag-for-the-perfectvacationdown-under.

Chic Helmet Totes: Give Love Cycle: The Guilden Large Carryall; http://velojoy.com/2013/05/16/give-love-cycle-bags/ Aug. 6, 2014.

* cited by examiner

DIVIDER AND KIT

CROSS-REFERENCE TO RELATED APPLICATIONS

This application is a nonprovisional utility application of the provisional patent application, Ser. No. 61/884,377, filed in the United States Patent Office on Sep. 30, 2013 and claims the priority thereof and is expressly incorporated herein by reference in its entirety.

TECHNICAL FIELD

The present disclosure relates generally to a divider and kit. More particularly, the present disclosure relates to a kit comprising a bag and a divider configured for maintaining food at desired temperature during transport.

BACKGROUND

Bags, sacks, containers, lunch bags, luggage, purses and backpacks are everyday items used for carrying and transporting a wide variety of things. Generally, these are containers with at least one opening and a cavity within that holds stuff. The bag cavities are either undifferentiated or have fixed dividers and defined pockets within the cavity.

Within the cavity of a bag, items move as the bag is moved, often crushing fragile items. The bottled water crushes the peaches. The hard-boiled egg rolls around, cracking prematurely, leaving bits of shell on everything in the bag. Within an insulated bag, everything is maintained at the same temperature, so the beverage may be cold, but so is the bread. The soup may be hot, but so is the fruit juice.

Bags that have fixed dividers often cannot accommodate different item sizes. Bags that have optional dividers have incremental fixed sizes that generally define cubical volumes that do not efficiently accommodate spherical and other non-cubical shapes. Fixed and optional dividers do not make maximum use of the volume available or provide protection against crushing, allowing items to rotate and rumble around within the cavity.

While these units may be suitable for the particular purpose employed, or for general use, they would not be as suitable for the purposes of the present disclosure as disclosed hereafter.

In the present disclosure, where a document, act or item of knowledge is referred to or discussed, this reference or discussion is not an admission that the document, act or item of knowledge or any combination thereof was at the priority date, publicly available, known to the public, part of common general knowledge or otherwise constitutes prior art under the applicable statutory provisions; or is known to be relevant to an attempt to solve any problem with which the present disclosure is concerned.

While certain aspects of conventional technologies have been discussed to facilitate the present disclosure, no technical aspects are disclaimed and it is contemplated that the claims may encompass one or more of the conventional technical aspects discussed herein.

BRIEF SUMMARY

An aspect of an example embodiment in the present disclosure is to provide a kit for transporting food while maintaining food at the correct temperature. Accordingly, an aspect of an example embodiment in the present disclosure provides a kit that includes a hot-cold pack, a divider configured for containing the hot-cold pack and a bag for holding the hot-cold pack and the divider.

Another aspect of an example embodiment in the present disclosure is to provide a plurality of insulated cells within a cavity of a bag, the cells isolating a plurality of items in the bag, one from the other. Accordingly, the present disclosure provides a divider having at least one panel configured for holding a hot-cold pack, the divider creating a plurality of cells within the bag, the divider isolating and insulating one cell from the other.

A further aspect of an example embodiment in the present disclosure is to provide a bag having an adjustable shelf within a cavity for storing a plurality of items in a cavity portion adjustable to the item size. Accordingly, the present disclosure provides an adjustable shelf that lowers and rises within the cavity, adjusting to the item size.

The present disclosure describes a carrying kit comprising a bag, a hot-cold pack and a divider configured for maintaining food at desired temperature during transport. The configurable flexible divider has at least one panel operative for creating insulated cells within a cavity of the bag, the cells isolating a plurality of items in the bag, one from the other. The cells can be maintained at different temperatures by hot-cold disposed within the panels of the divider. The divider further protects the items within the cell from crushing and from shock. In one example embodiment, the bag has an adjustable shelf splitting the cavity into upper and lower portions. The shelf attaches to the cavity by at least one flap that rises and lowers the shelf. The lower cavity portion is accessible through a horizontal opening.

The present disclosure describes a configurable flexible divider having a plurality of panels operative for creating insulated cells within a cavity of a bag, the cells isolating a plurality of items in the bag, one from the other. The cells can be maintained at different temperatures by gel packs disposed within the panels of the divider. The divider further protects the items within the cell from crushing and from shock. The divider is useful in lunch bags, but not limited to lunch bags and can be used in any bag or container where items require isolation and insulation.

The present disclosure addresses at least one of the foregoing disadvantages. However, it is contemplated that the present disclosure may prove useful in addressing other problems and deficiencies in a number of technical areas. Therefore, the claims should not necessarily be construed as limited to addressing any of the particular problems or deficiencies discussed hereinabove. To the accomplishment of the above, this disclosure may be embodied in the form illustrated in the accompanying drawings. Attention is called to the fact, however, that the drawings are illustrative only. Variations are contemplated as being part of the disclosure.

BRIEF DESCRIPTION OF THE DRAWINGS

In the drawings, like elements are depicted by like reference numerals. The drawings are briefly described as follows.

The present disclosure now will be described more fully hereinafter with reference to the accompanying drawings, which show various example embodiments. However, the present disclosure may be embodied in many different forms and should not be construed as limited to the example embodiments set forth herein. Rather, these example embodiments are provided so that the present disclosure is thorough, complete and fully conveys the scope of the present disclosure to those skilled in the art.

DETAILED DESCRIPTION OF THE PREFERRED EMBODIMENTS

Figure 2:
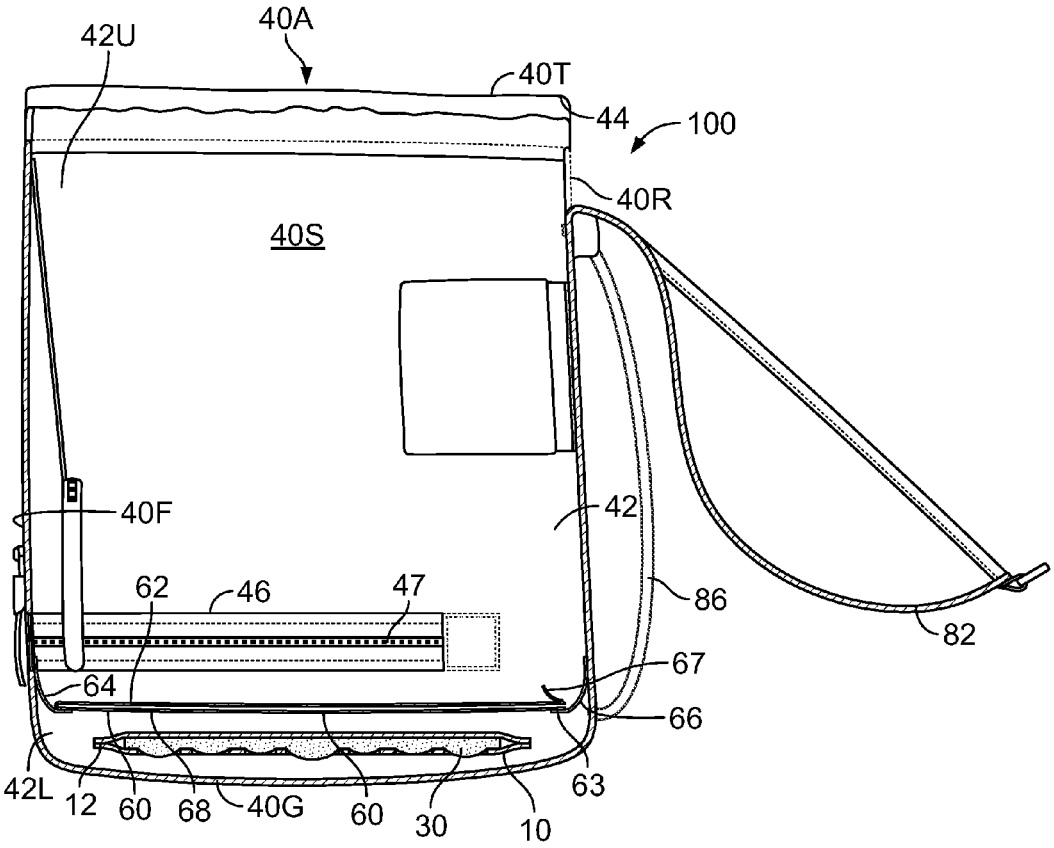
FIG. 2 is a cross-section of a side elevational view of an example embodiment of the bag, showing an interior cavity with an adjustable shelf.

FIG. 2 illustrates an example embodiment of a kit 100 for maintaining food at desired temperatures during transport. Whether a user is carrying a mid-day meal, a snack or a dish for a potluck supper, the kit keeps hot food hot and cold food cold. In one example embodiment, the kit protects more fragile food items such as fruit from being crushed or bruised.

The example embodiment as illustrated in FIG. 2 comprises a bag 40A, a flexible divider 10 and a hot-cold pack 30.

In the example embodiment shown in FIG. 2, the bag 40A has a bottom 40G, a front 40F, a back 40R and a pair of sides 40S connecting the front 40F and back 40R. The bag 40A has a top outlet 44 having a closure 82. The bag 40A has an interior cavity 42 that includes an upper cavity portion 42U and a lower cavity portion 42L. The bag 40A has a horizontal opening 46 towards the bag bottom 40G. The horizontal opening 46 extends across the bag front 40F, continuing substantially halfway around each bag side 40S. The horizontal opening 46 provides access to the lower cavity portion 42L. The horizontal opening 46 has a closure 47. In the illustration, the closure 47 is a zipper, but this is not a limitation. The closure 46 can be a zipper, a hook and loop closure, snaps or other suitable closure systems well known to those of ordinary skill.

The example embodiment of the bag 40A has an adjustable shelf 60 inside the interior cavity 42. The adjustable shelf 60 splits the interior cavity 42 into the upper cavity portion 42U and the lower cavity portion 42L. The shelf 60 is configured for rising to increase the lower cavity portion 42L and to decrease the upper cavity portion 42U and is further configured for lowering to decrease the lower cavity portion 42L and increase the upper cavity portion 42U, the shelf 60 selectively lowering and rising to accommodate objects placed into the lower cavity portion 42L through the horizontal opening 46.

The example embodiment of the kit further comprises a flexible divider 10 and a hot-cold pack 30. The flexible divider 10 is configured for holding the hot-cold pack 30, the divider having at least one panel 12. The divider 10 provides thermal and shock insulation. The hot-cold pack 30 exchanges thermal energy with the exterior of the divider, thereby maintaining food at a desired temperature during transport inside the bag.

It is well understood by those of ordinary skill that hot-cold packs maintain temperature by exchanging thermal energy. For example, when the hot-cold pack is cold, the hot-cold pack absorbs the heat from another object, thereby removing thermal energy and lowering the temperature of the object until thermal equilibrium is reached between the hot-cold pack and the object. When the hot-cold pack is hot, it transfers heat to another object, thereby providing thermal energy and increasing the temperature of the object, until thermal equilibrium is reached between the hot-cold pack and the object. The hot-cold packs are typically filled with water, aqueous gels, aqueous solutions and glycols that have a latent heat of fusion. A further discussion of hot-cold pack fillings is beyond the scope of this disclosure.

Figure 9:
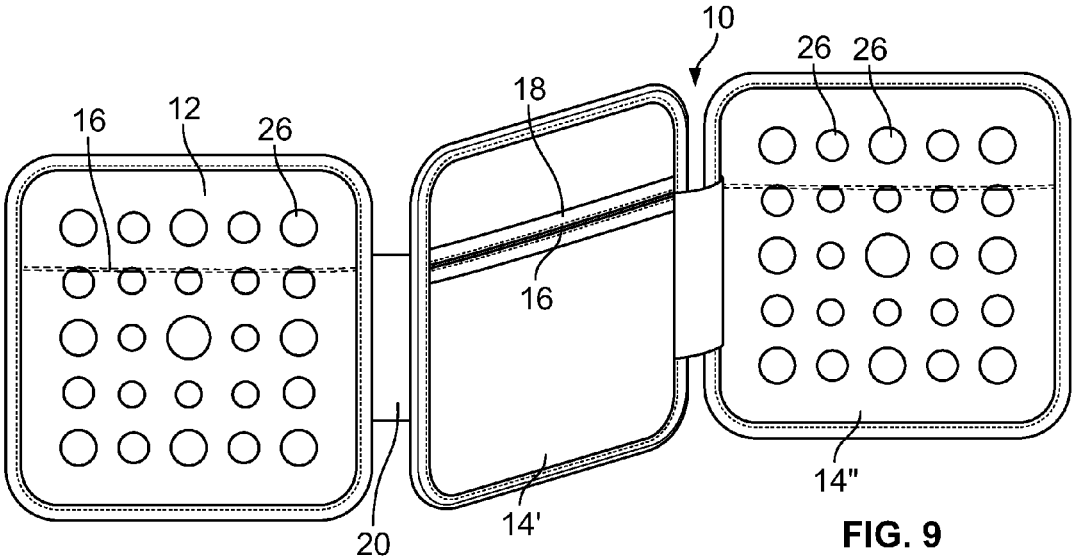
FIG. 9 is a dynamic perspective view of an example embodiment of a divider.
Figure 11A:
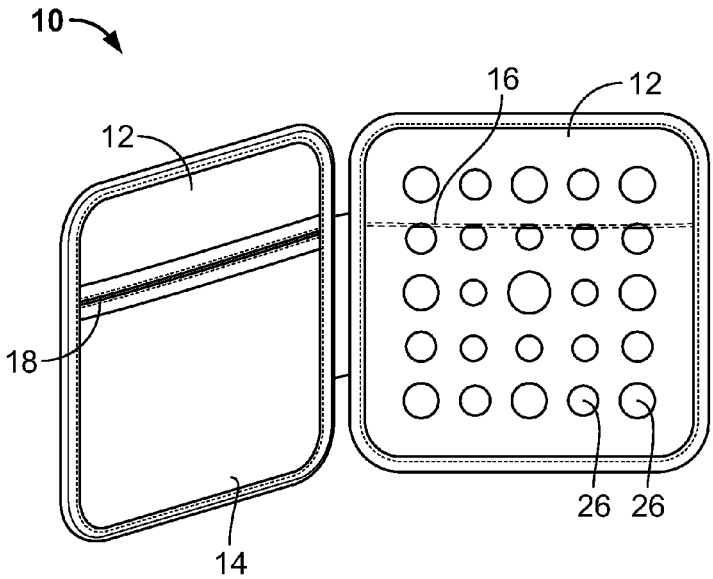
FIG. 11A is a dynamic perspective view of another example embodiment of a divider.
Figure 11B:
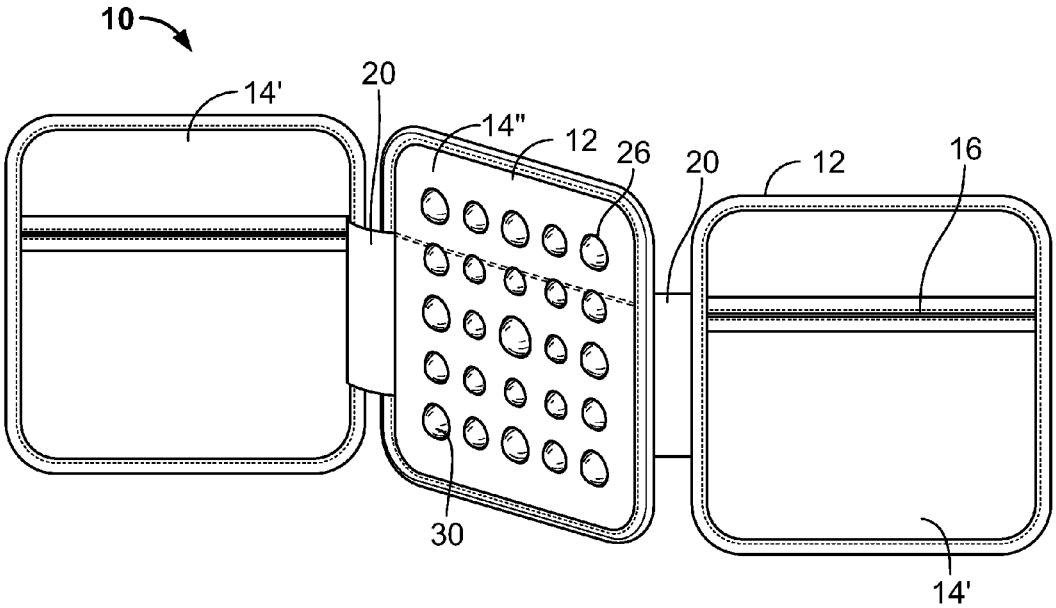
FIG. 11B is a dynamic perspective view of an example embodiment of the divider with a hot-cold pack therewithin.

FIGS. 9, 11A and 11B show further example embodiments of the divider 10 having the at least one panel 12. FIG. 11A is an example embodiment of a bi-fold configuration; FIGS. 9 and 11B are example embodiments of a trifold configuration. The at least one panel 12 has a pair of opposing walls 14, a first wall 14' and a second wall 14". The walls 14 define an interior pocket 18 and an exterior. The first wall 14' is a thermal and shock insulator. The first wall 14' has a slot 16 configured for inserting the hot-cold pack 30 into the interior pocket 18. The at least one panel 12 has the second wall 14" that has a plurality of vents 26, the vents configured for exchanging thermal energy between the hot-cold pack 30 in the interior pocket 18 and the exterior, the divider 10 and hot-cold pack 30 operative for maintaining food at desired temperature during transport inside the bag. The divider 10 is operative for preventing crushing and bruising of food by insulating against shock caused by a force, such as when items collide within the bag.

In one example embodiment, the panels 12 connect via a folding member 20. The panels 12 are arranged so that the first wall 14' of a first panel is adjacent to the second wall 14". The number of panels 12 connecting in this matter is not a limitation and the divider 10 can be configured in a bi-fold, a trifold or other multifold configurations and the number of folds formed by folding members 20 is not a limitation. It is further understood that the shape of the panels is not a limitation and the panels can be made in both regular and irregular shapes.

Each panel 12 can flexibly bend to conform to the shape of an item. Each folding member 20 in the divider 10 hingedly rotates substantially in a full circle, the divider configurable to define a plurality of irregular volumes, creating custom cells within a bag.

In one example embodiment, the panel 12 lacks vents and the slot 16 has an airtight closure. The pocket 18 can selectively be filled with air to provide additional thermal and shock insulation.

Figure 10:
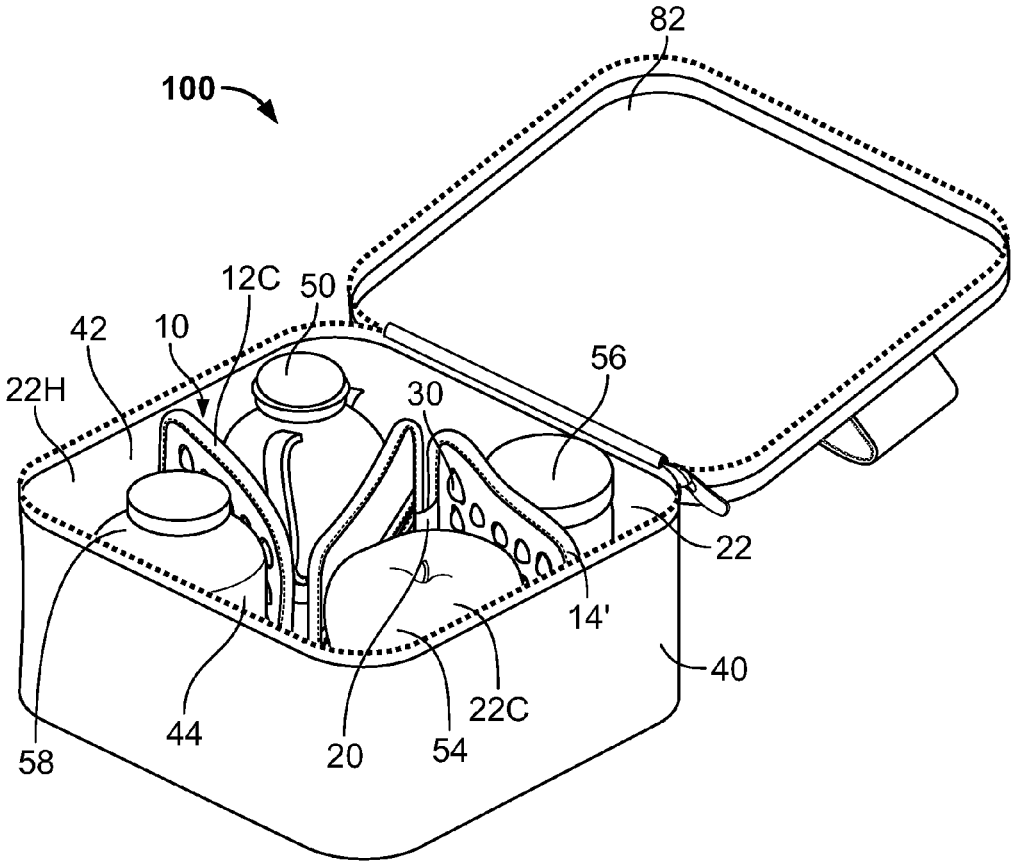
FIG. 10 is a dynamic perspective view of another example embodiment of a bag with an example embodiment of the divider in place.
Figure 12:
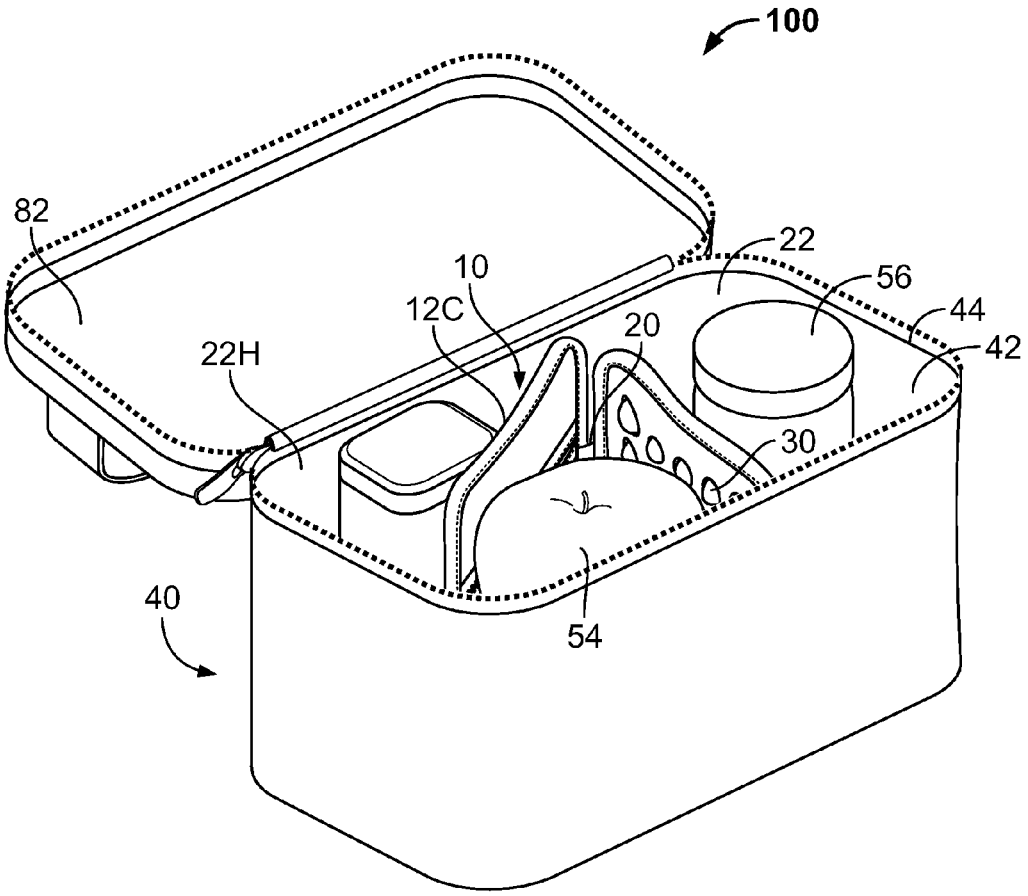
FIG. 12 is a dynamic perspective view of another example embodiment of the bag with another example embodiment of the divider in place.
Figure 13:
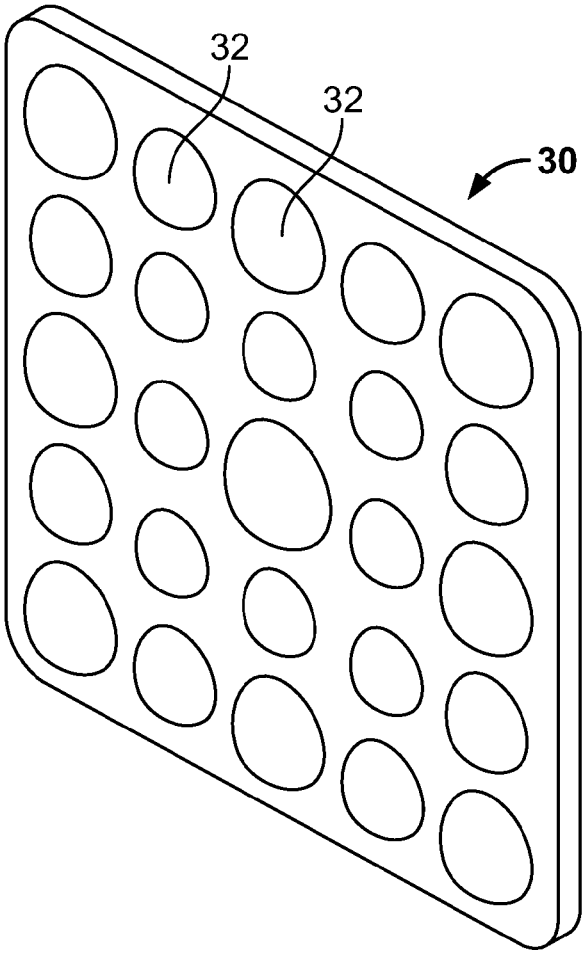
FIG. 13 is a dynamic perspective view of an example embodiment of a contoured hot-cold pack with a plurality of protuberances.
Figure 14:
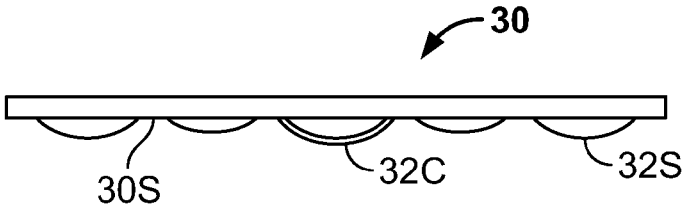
FIG. 14 is a side elevational view of an example embodiment of the contoured hot-cold pack with a plurality of protuberances.
Figure 15:
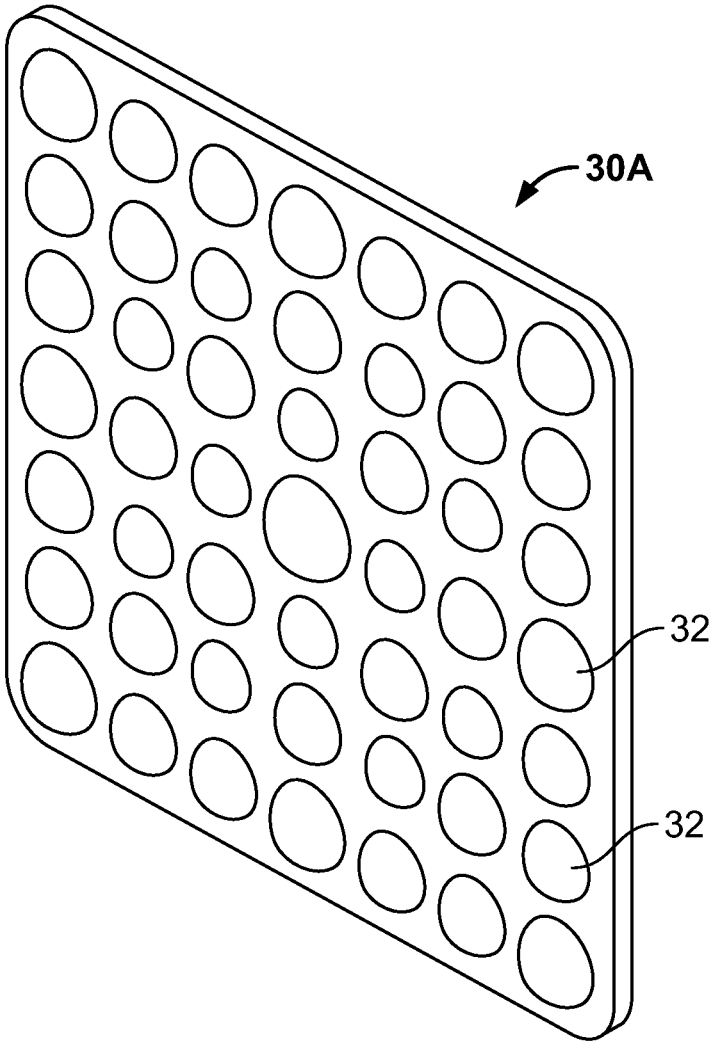
FIG. 15 is a dynamic perspective view of another example embodiment of a contoured hot-cold pack with a plurality of protuberances.
Figure 16:
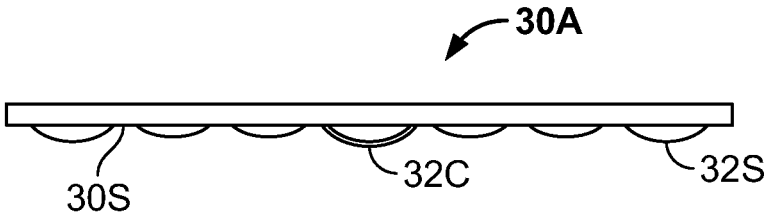
FIG. 16 is a side elevational view of another example embodiment of the contoured hot-cold pack with a plurality of protuberances.

FIGS. 10 and 12 show another example embodiment of the kit in a bag 40 having a regular cubical cavity 42 as a non-limiting example. The divider defines four irregular volumes creating a plurality of cells 22, 22H, 22C that are hot 22H, cold 22C and neutral and provide shock insulation against crushing a plurality of items stored therein. One panel 12 of the divider 10 can rotate with respect to an adjacent panel 12, the panels defining a plurality of cells 22 within the bag 40 when the panels 12 are placed in an extended and rotated position.

The divider 10 wraps around a piece of fruit 54, the panel 12 having one cold hot-cold pack 30 in the pocket of the panel 12. The folding members 20 create a thermally neutral cell 22 that provide shock insulation for a glass container 56. Another folding member 20 creates a warm cell 22H for a container of soup 58, the panel 12C conforming to the shape of the soup container 58 and having a hot hot-cold pack in the pocket. The divider 10 can be reconfigured in an almost infinite combination, providing a flexible solution for keeping hot items hot, cold items cold and fragile items intact.

In the illustrated example embodiment, the divider 10 is placed with the folding members 20 in a vertical position. However, it is understood by those of ordinary skill that in a container that has a differently shaped cavity, the folding members can be in a horizontal position if the items are stacked within the cavity of the bag. The illustrations show the folds between the panels in parallel, but it is understood by those of ordinary skill that the folds can be orthogonal as well as forming an "L" shape, a "V" shape, a "T" shape as well as other configurations within the inventive concept.

FIGS. 13-16 demonstrate example embodiments of the hot-cold pack 30. In these example embodiments, the hot-cold pack 30 has a surface 30S having a plurality of protrusions 32. The protrusions 32 are configured for extending through the vents on the second wall of the divider described hereinabove. The protrusions 32 can have the same height in one example embodiment, can vary randomly or can have higher side protrusions 32S along the side and the highest protrusion 32C in the center. The protrusions 32 coincide with the vents in the divider discussed hereinabove. Other embodiments of the kit can have hot-cold packs without protrusions.

Figure 8:
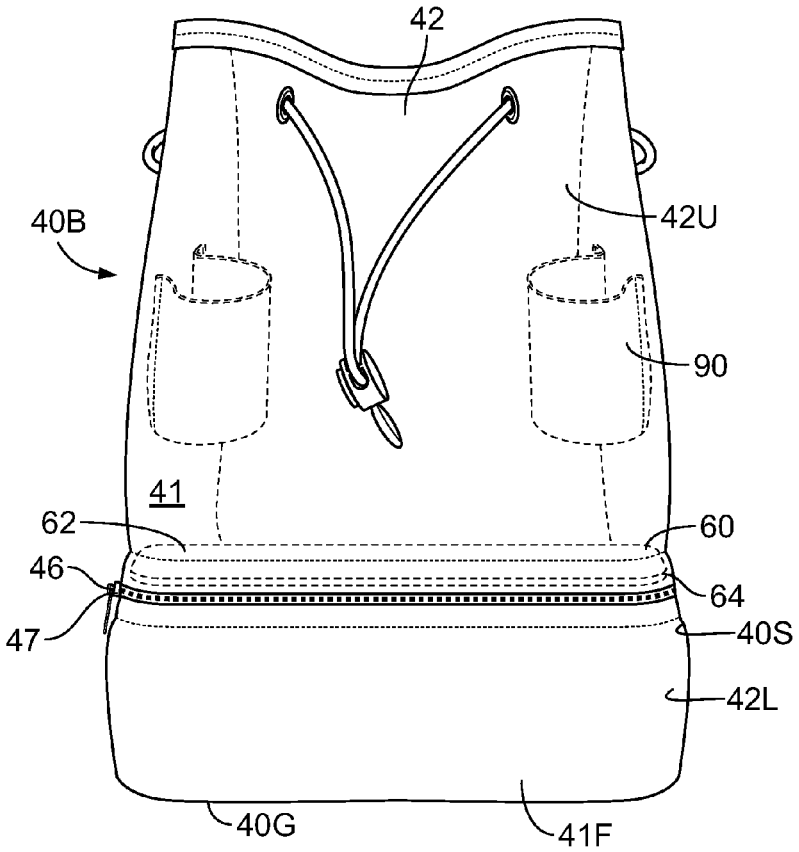
FIG. 8 is a front elevational view of the further example embodiment of the bag showing the adjustable shelf.

Referring to FIG. 8, a further example embodiment of the bag 40B is drawn. The bag 40B has an inner wall 41 defining the interior cavity 42. The bag 40B has a sleeve 62 configured for holding the shelf 60, the sleeve 62 attaching to the inner wall 41 of the bag 40B by at least one flap 64 configured for attaching the sleeve 62 to the inner wall 41 of interior cavity 42 of the bag 40B. The at least one flap 64 is configured for selectively raising and lowering the shelf 60 while maintaining the sleeve 62 attaching to the inner wall 41 of the bag.

The at least one flap 64 attaches across the inner wall front 41F, continuing substantially halfway around each side 40S, the at least one flap 64 coextending with the horizontal opening 46 towards the bag bottom 40G so when the closure 47 of the horizontal opening 46 is opened to access the lower cavity portion 42L, the at least one flap 64 blocks access to the upper cavity portion 42U.

Figure 6:
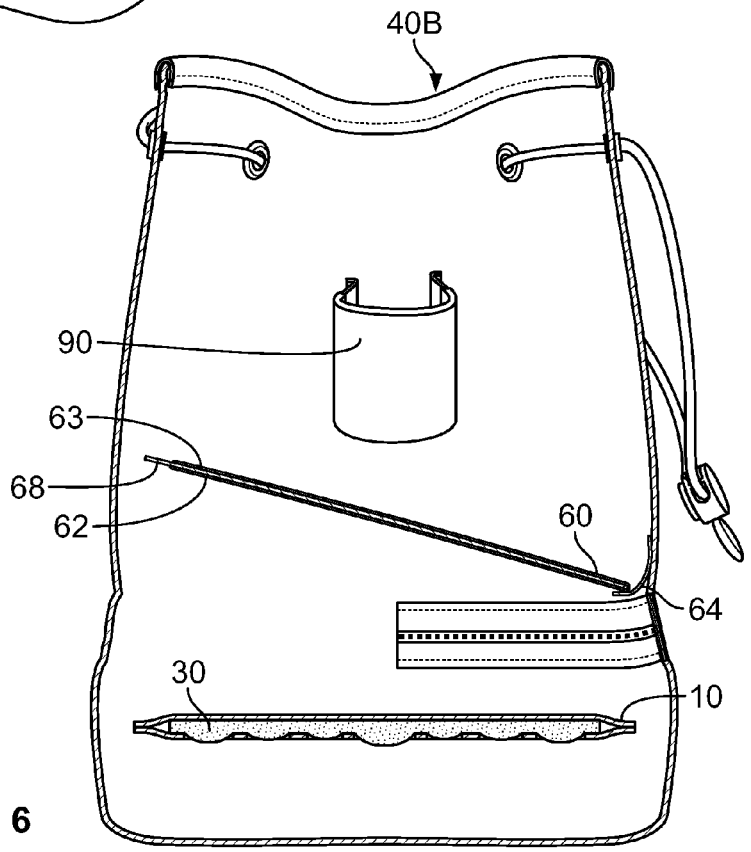
FIG. 6 is a cross-section of a side elevational view of the further example embodiment of the bag, showing an adjustable shelf.

Referring to FIG. 6, the sleeve 62 has an opening 63 opposite the at least one flap 64. The shelf 60 has a board 68 and the board 68 is selectively removable from the sleeve 62 through the opening 63. The board 68 is substantially rigid.

Referring to FIG. 2, in this example embodiment, the sleeve 62 in the bag 40A has a second attachment flap, the flap a narrow strip 66, the strip attaching to the bag back 40R. The sleeve 62 has a tab 67 adjacent to the opening 63, the tab configured for extending the opening 63 open, operative for removing the board 68 from the sleeve 62.

FIG. 2 shows the shelf 60 below the horizontal opening, the shelf lowering and increasing the upper cavity portion, adjusting to a smaller load in the lower cavity portion 42L. When the lower cavity portion 42L is empty, the shelf 60 lowers to the bottom 40G of the bag 40A, eliminating the lower cavity portion when the lower cavity portion not in use.

Figure 3:
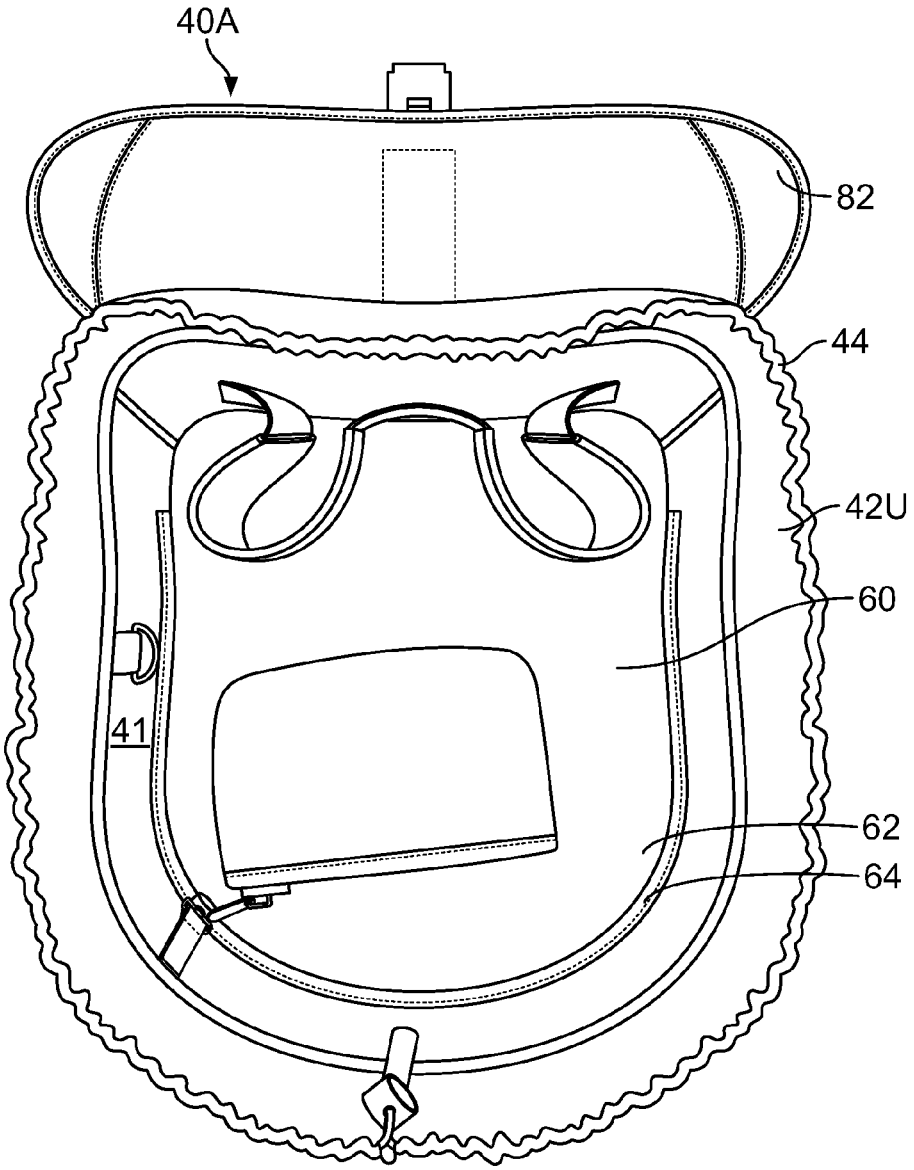
FIG. 3 is a top plan view of an example embodiment of an open bag showing the interior cavity with the adjustable shelf.
Figure 4:
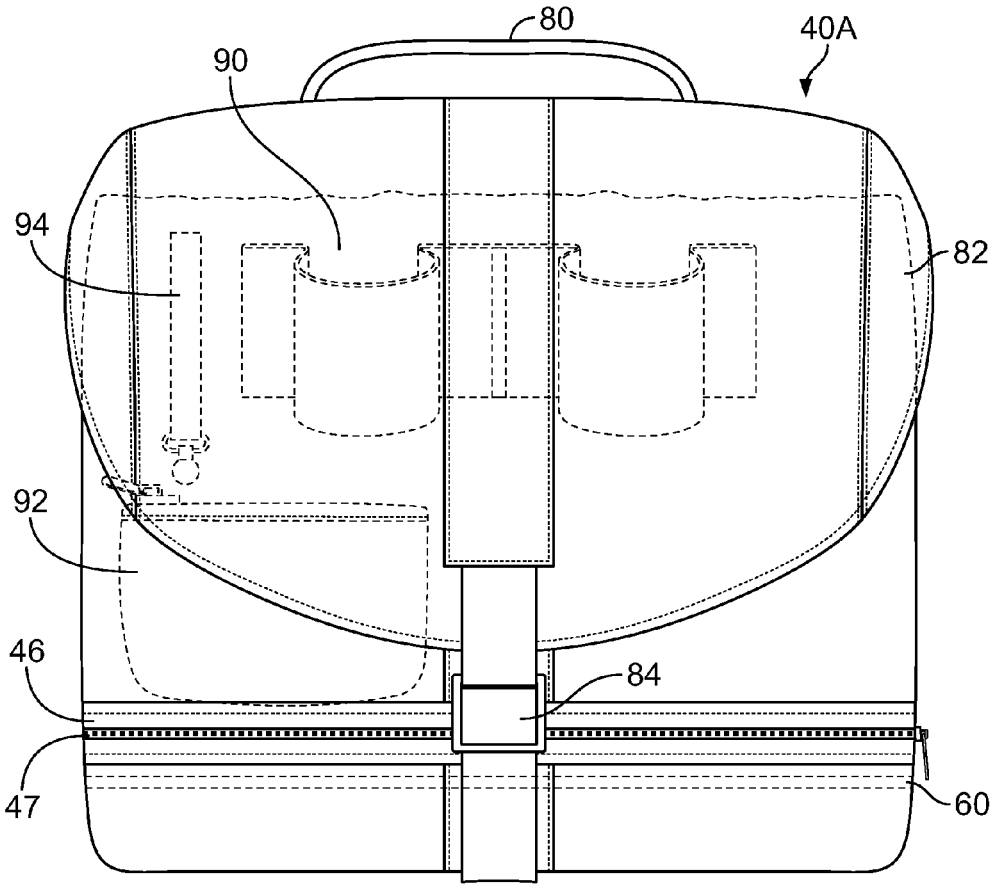
FIG. 4 is a front elevational view of an example embodiment of the bag showing the adjustable shelf.
Figure 5:
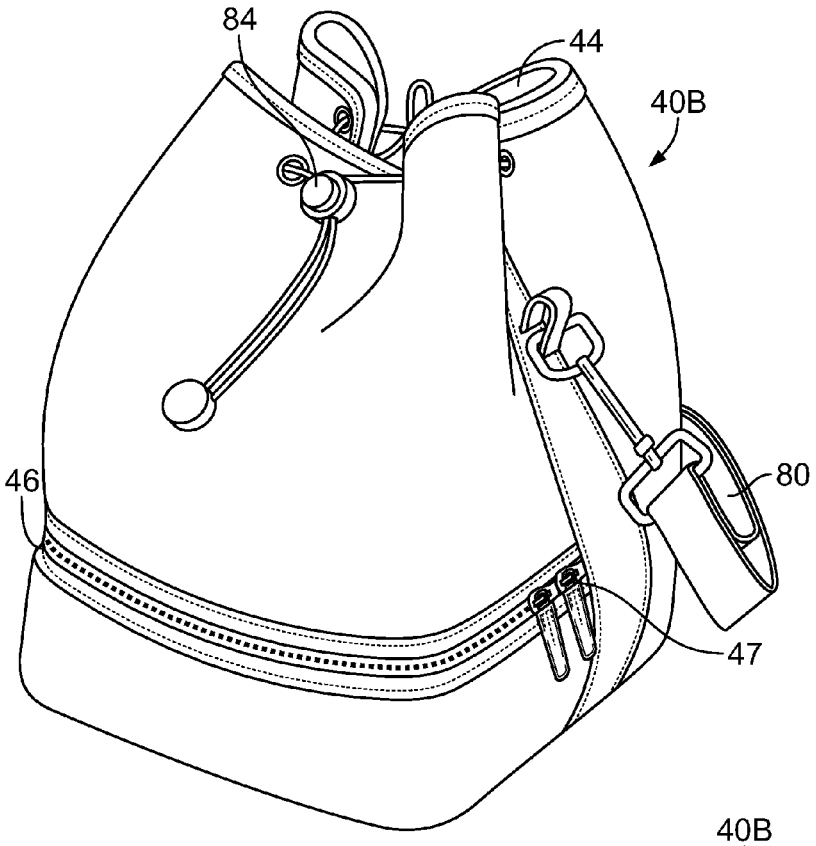
FIG. 5 is a dynamic perspective view of a further example embodiment of a bag.
Figure 7:
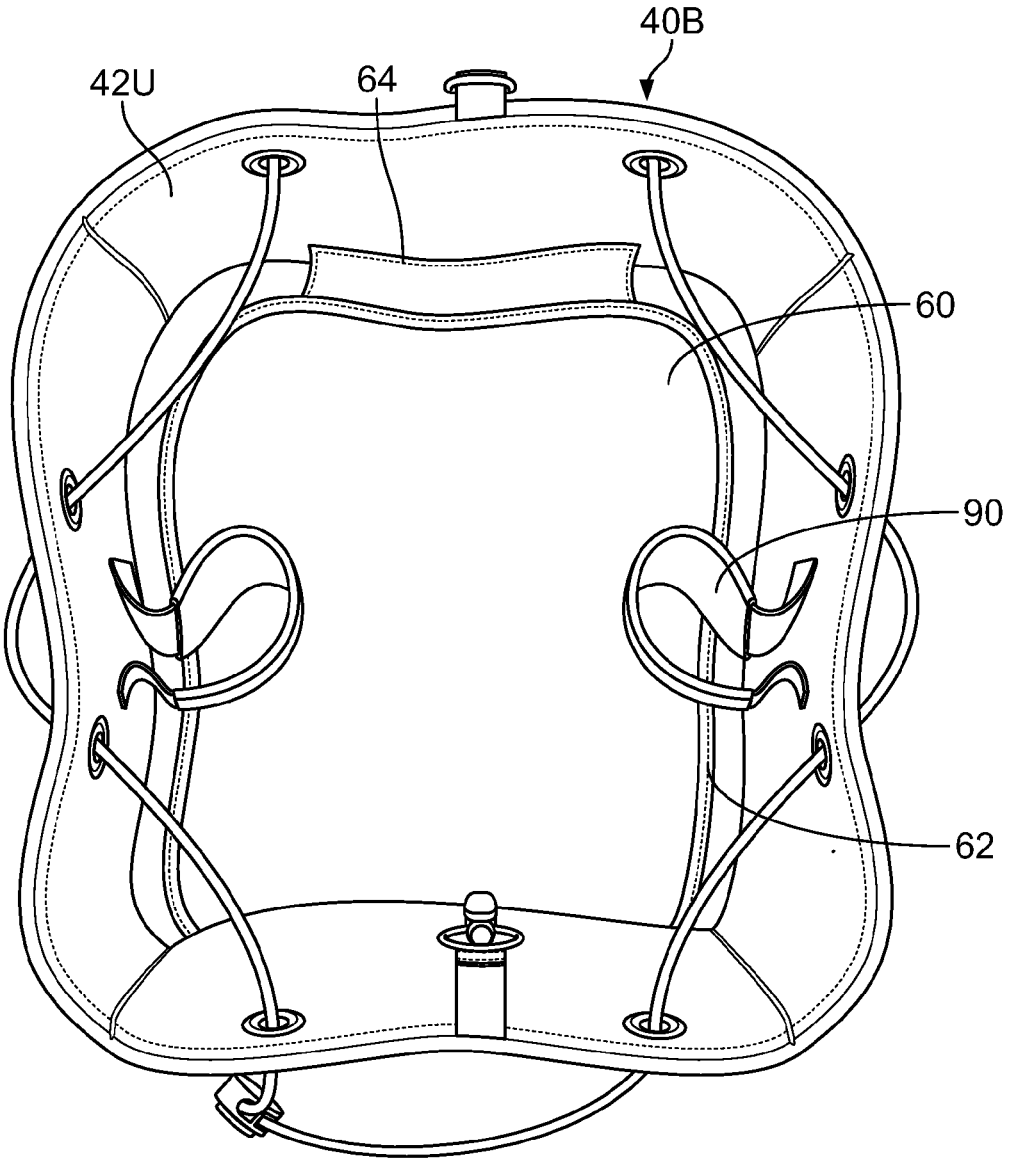
FIG. 7 is a top plan view of the further example embodiment of the open bag showing the interior cavity with the adjustable shelf.

Referring to FIGS. 3 and 7, the shelf 60 rises and lowers. In FIG. 3, the flap 64 is elongated and the inner wall 41 is foreshortened, showing a raised shelf 60 in the sleeve 62, moving upwards into the upper cavity portion 42U in the bag 40A. In FIG. 7, the flap 64 is shortened and inner wall 41 is elongated, showing a lowered shelf 60 in the sleeve 62, moving downwards, enlarging the upper cavity portion 42U.

As shown in FIGS. 2, 3, 4, 6, 7 and 8, the bag 40A, 40B, the upper cavity portion 42U has at least one receptacle 90 for securing a smaller container.

As shown in FIGS. 1-4, 10 and 12, the top outlet 44 has a covering 82 that selectively latches 84 in a closed position. The bag 40, 40A further comprises a handle.

Figure 1:
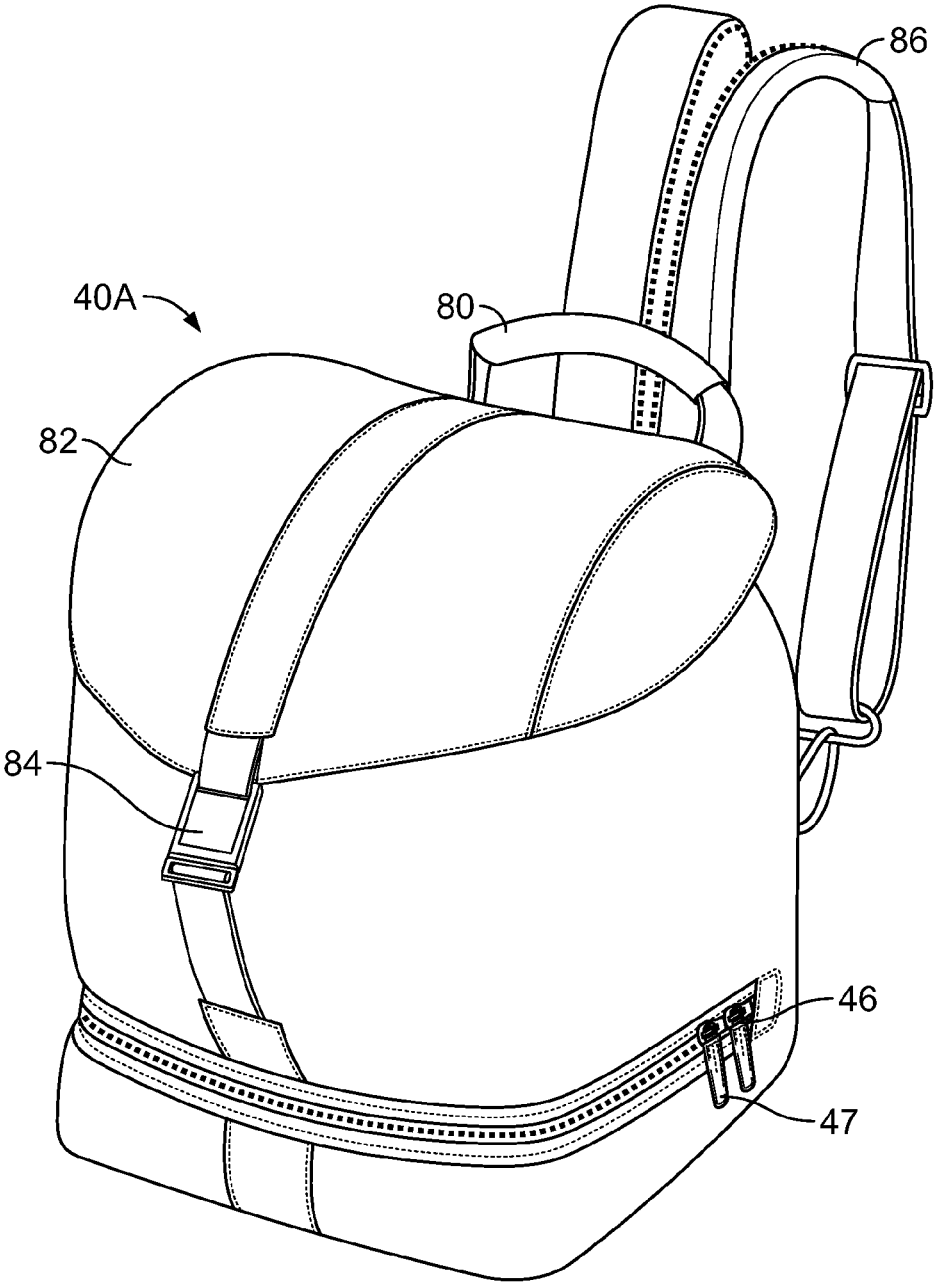
FIG. 1 is a dynamic perspective view of an example embodiment of a bag.

As shown in FIGS. 1 and 2, the bag further comprises at least one shoulder strap 86.

The shelf 60 inside a sleeve 62 is extending upwardly into the upper cavity portion 42U, the lower cavity portion enlarging as the shelf rises. The bag 40B has an inner wall 41 and a flap 64 attaches the sleeve 62 to the inner wall 41.

The illustrated example embodiments show non-limiting example of bags and the kit is not limited to one particular style of bag, but many types of bags without limit, such as diaper bags, purses, picnic bags, purses, luggage, gym bags, tool bags, backpacks, camera bags, laptop cases, tablet computer cases and specialty bags such as coffee bar bags, liquor bar bags as well.

Referring to FIG. 2, a method of constructing the shelf 60 and installing the shelf in the bag 40A. The sleeve 62 is formed with an opening. At least one flap 64 is attached to the sleeve 62, opposite the opening 63. The board 68 is placed inside the sleeve 62 through the opening 63. The at least one flap 64 is attached to the inner wall 41 of the bag 40A, the at least one flap 64 above the horizontal opening 46 in the bag 40A. In one example embodiment of the method, the board 68 is placed inside the sleeve 62 after the sleeve is attached to the inner wall 41.

In one example embodiment, the flap 64 extends across the front of the bag and substantially half way around the bag sides.

It is understood that when an element is referred hereinabove as being "on" another element, it can be directly on the other element or intervening elements may be present therebetween. In contrast, when an element is referred to as being "directly on" another element, there are no intervening elements present.

Moreover, any components or materials can be formed from a same, structurally continuous piece or separately fabricated and connected.

It is further understood that, although ordinal terms, such as, "first," "second," "third," are used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

Spatially relative terms, such as "beneath," "below," "lower," "above," "upper" and the like, are used herein for ease of description to describe one element or feature's relationship to another element(s) or feature(s) as illustrated in the figures. It is understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device can be otherwise oriented (rotated 90 degrees or at other orientations) and the spatially relative descriptors used herein interpreted accordingly.

Example embodiments are described herein with reference to cross section illustrations that are schematic illustrations of idealized embodiments. As such, variations from the shapes of the illustrations as a result, for example, of manufacturing techniques and/or tolerances, are to be expected. Thus, example embodiments described herein should not be construed as limited to the particular shapes of regions as illustrated herein, but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

In conclusion, herein is presented a carrying kit comprising a bag and a divider configured for maintaining food at desired temperature during transport. The disclosure is illustrated by example in the drawing figures, and throughout the written description. It should be understood that numerous variations are possible, while adhering to the inventive concept. Such variations are contemplated as being a part of the present disclosure.

What is claimed is:

1. A flexible divider, comprising: at least one panel, the panel having a pair of opposing walls, a first wall and a second wall, the walls defining an interior pocket and an exterior of the panel, the first wall constructed of a thermal and shock insulator; a slot on the first wall operative for accessing the interior pocket; and a plurality of vents on the second wall operative for exchanging thermal energy between the interior pocket and the exterior of the panel; the interior pocket is configured for holding a hot-cold pack; and wherein the hot-cold pack has a surface having a plurality of protrusions, the protrusions extending through the vents on the second wall.

2. The flexible divider as described in claim 1, wherein a hot-cold pack is inserted through the slot in the first wall into the interior pocket, the hot-cold pack operative for exchanging thermal energy through the vents on the second wall.

3. The flexible divider as described in claim 1, further comprising a plurality of panels hingedly connected, one panel rotating with respect to an adjacent panel, the panels defining a plurality of cells within a container when the panels are placed in a extended and rotated position.

4. The flexible divider as described in claim 3, wherein the panels are connected by at least one folding member, a pair of panels connecting by the at least one folding member such that one panel flexible rotates substantially in a full circle with respect to the adjacent panel.

5. The flexible divider as described in claim 1, wherein the divider is made from a flexible insulating material selected from the group consisting of neoprene, neoprene foam, polyester/nylon and silicone.

6. A kit for maintaining food at desired temperature during transport, comprising: a hot-cold pack; a bag, having a top outlet having a closure, said bag having an interior cavity having an upper cavity portion and a lower cavity portion, said bag having a horizontal opening, said opening towards the bag bottom, said horizontal opening extending across the bag front, continuing substantially halfway around each bag side, the horizontal opening providing access to the lower cavity portion, said opening having a closure, said bag having an adjustable shelf inside the interior cavity, the adjustable shelf splitting the interior cavity into the upper cavity portion and the lower cavity portion, the shelf configured for rising to increase the lower cavity portion, the shelf further configured for lowering to decrease the lower cavity portion, the shelf selectively lowering and rising to accommodate objects placed into the lower cavity portion through the horizontal opening; and a flexible divider configured for holding said hot-cold pack, the divider having at least one panel, the panel having a pair of opposing walls, a first wall and a second wall, the walls defining an interior pocket and an exterior of the panel, the first wall constructed of a thermal and shock insulator, a slot on the first wall configured for inserting said hot-cold pack into the interior pocket, the panel having a plurality of vents on the second wall, the vents configured for exchanging thermal energy between hot-cold pack in the interior pocket and the exterior of the panel, the divider operative for maintaining food at desired temperature during transport inside the bag; and wherein the hot-cold pack has a surface having a plurality of protrusions, the protrusions extending through the vents on the second wall of the divider.

7. The kit as described in claim 6, wherein the flexible divider is made from a flexible insulating material selected from the group consisting of neoprene, neoprene foam, polyester/nylon and silicone.

8. The kit as described in claim 6, wherein the bag further comprises an inner wall defining the interior cavity, the bag having a sleeve configured for holding the shelf, the sleeve attaching to the inner wall of the bag.

9. The kit as described in claim 8, wherein the bag further comprises the sleeve having at least one flap configured for attaching to the interior cavity of the bag, the at least one flap configured for selectively raising and lowering the shelf while maintaining the sleeve attaching to the inner wall of the bag.

10. The kit as described in claim 9, wherein the at least one flap of the sleeve attaches across the inner wall front of the bag, continuing substantially halfway around each side, the at least one flap coextending with the horizontal opening towards the bag bottom so that the horizontal opening access the lower cavity portion, the at least one flap blocking access to the upper cavity portion.

11. The kit as described in claim 10, wherein the bag further comprises the sleeve having an opening opposite the at least one flap and the shelf is selectively removable from the sleeve through the opening.

12. The kit as described in claim 11, wherein the shelf in the bag is substantially rigid.

13. A kit for maintaining food at desired temperature during transport, comprising: a hot-cold pack; a bag, having a top outlet having a closure, said bag having an interior cavity; and a flexible divider configured for holding said hot-cold pack, the divider having at least one panel, the panel having a pair of opposing walls, a first wall and a second wall, the walls defining an interior pocket and an exterior of the panel, the first wall constructed of a thermal and shock insulator, a slot on the first wall configured for inserting said hot-cold pack into the interior pocket, the panel having a plurality of vents on the second wall, the vents configured for exchanging thermal energy between hot-cold pack in the interior pocket and the exterior of the panel, the divider operative for maintaining food at desired temperature during transport inside the bag; and wherein the hot-cold pack has a surface having a plurality of protrusions, the protrusions extending through the vents on the second wall of the divider.

14. The kit as described in claim 13, wherein the flexible divider is made from a flexible insulating material selected from the group consisting of neoprene, neoprene foam, polyester/nylon and silicone.

15. The kit as described in claim 13, wherein the bag further comprises the top outlet having a covering that selectively latches in a closed position.

16. The kit as described in claim 13, wherein the bag further comprises a handle.

* * * * *